US012171386B2

(12) United States Patent
McKenzie

(10) Patent No.: US 12,171,386 B2
(45) Date of Patent: Dec. 24, 2024

(54) L SHAPE HALF MITT

(71) Applicant: Rebecca Ann McKenzie, Littleton, CO (US)

(72) Inventor: Rebecca Ann McKenzie, Littleton, CO (US)

(73) Assignee: Rebecca McKenzie, Highlands Ranch, CO (US)

( * ) Notice: Subject to any disclaimer, the term of this patent is extended or adjusted under 35 U.S.C. 154(b) by 0 days.

(21) Appl. No.: 16/024,848

(22) Filed: Jun. 30, 2018

(65) Prior Publication Data

US 2020/0000306 A1 Jan. 2, 2020

(51) Int. Cl.
*A47L 13/00* (2006.01)
*A47L 13/18* (2006.01)

(52) U.S. Cl.
CPC ..... *A47L 13/18* (2013.01)

(58) Field of Classification Search
CPC ..... A47L 13/18; A47L 13/16
See application file for complete search history.

(56) References Cited

U.S. PATENT DOCUMENTS 2,095,379 A * 10/1937 Coney ..... B24D 9/00 451/511
2,441,745 A * 5/1948 Benamy ..... A41B 13/06 2/69
2,756,448 A * 7/1956 Werbe ..... A63H 3/14 15/118
3,608,708 A * 9/1971 Storandt ..... A47L 13/18 206/361
4,110,846 A * 9/1978 Hernandez ..... A42B 1/045 2/203
4,234,994 A * 11/1980 Schwab ..... A47K 7/022 15/222
4,516,616 A * 5/1985 Fesler ..... A63B 57/00 15/210.1
4,893,372 A * 1/1990 Wenzel ..... A41D 13/08 15/227
4,959,881 A * 10/1990 Murray ..... A47L 13/18 15/104.94
5,127,127 A * 7/1992 Jarosinski ..... A47L 13/18 15/104.94
5,473,789 A * 12/1995 Oster ..... A47L 13/19 15/104.94
D418,954 S * 1/2000 Ferdenzi ..... D28/63
6,024,970 A * 2/2000 Woodard ..... A47L 13/18 15/227
D470,704 S * 2/2003 Varon ..... D6/608
6,769,153 B1 * 8/2004 Post ..... A47L 1/15 15/232
7,240,391 B1 * 7/2007 Boze ..... A47L 13/18 15/104.94
D674,147 S * 1/2013 Martin, Jr. ..... D29/113
D675,810 S * 2/2013 Bridges ..... D2/825
D779,142 S * 2/2017 Baldwin ..... D32/40
9,848,751 B2 * 12/2017 McKenzie ..... A47K 10/02
10,092,932 B2 * 10/2018 Oster ..... B08B 1/006
D857,322 S * 8/2019 Kondyra ..... D32/40
D937,011 S * 11/2021 Suen ..... D6/592
2001/0047534 A1 * 12/2001 Sandusky ..... A47L 13/19 2/158
2003/0217425 A1 * 11/2003 Datta ..... B31B 70/00 15/227
2009/0032059 A1 * 2/2009 Tuman ..... A47L 25/08 134/9
2011/0119850 A1 * 5/2011 Mallory ..... D04H 5/03 15/209.1
2011/0209296 A1 * 9/2011 Hong ..... A47L 13/44 15/118
2014/0020710 A1 * 1/2014 Williams ..... A47L 13/16 134/6
2017/0049279 A1 * 2/2017 Wood ..... A47K 10/02
2017/0360214 A1 * 12/2017 Jensen ..... A47K 10/02
2019/0159539 A1 * 5/2019 Pacheco ..... A42B 7/00

* cited by examiner

*Primary Examiner* — Steven O Douglas

(57) ABSTRACT

The L shape half mitt is a wiping towel formed into a mitt style shape, and providing an additional open side so the user can easily slide the hand inside the cavity of the mitt from either of two adjacent openings and accessing the one corner as a stiffened cleaning edge and having two open sides and two closed sides and allowing the user to wrap the extra amount of towel material around the hand of the user or an item placed within the pocket cavity and to wrap the opened flap of material around the item placed within.

2 Claims, 10 Drawing Sheets

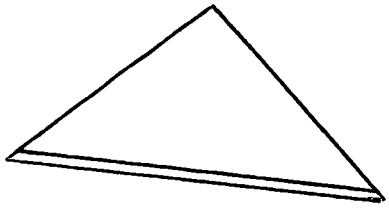
FIG. 4-I
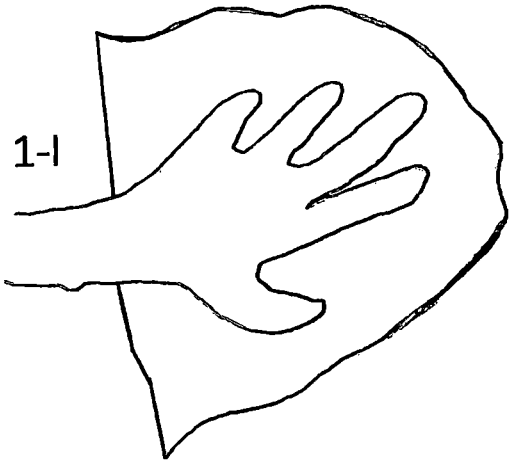
FIG. 1-I
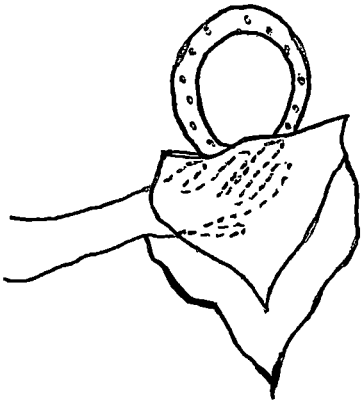
FIG. 3-I
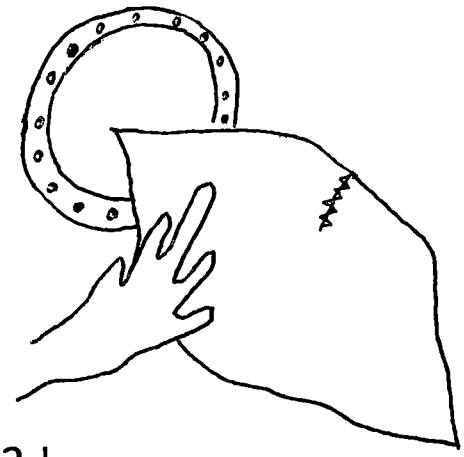
FIG. 2-I

L SHAPE HALF MITT

BACKGROUND OF THE INVENTION

Field of Invention

This invention relates to wiping towels relevant to household cleaning or any profession that uses rags or towels for cleaning up. Holding onto a rag to clean with is always causing hand fatigue. A wiping towel that is quickly adhered to the user's hand, but without the time consuming properties of "on, or "off", is always desirable. Especially in a user with any sort of arthritis or impairment or injury to the user's hand, a rag with a method of holding onto it and the properties to do so are very desirable in a wiping rag. A towel that can compact and then spread out fully is useful in cleaning and tasking to wash, wipe, dry, dust, clean polish, scrub, etc.

A drawback of usual style mitt having three closed sides, and one opening for the user's hand to be inserted. The basis of the mitt entails the user to have a usual style mitt "on" or "off." Also the size of a usual mitt is only of the material which is of the mitt to cover the hand, and limits the amount of usable material to that of only a hand.

SUMMARY

In accordance with the present invention a L Shape Half Mitt comprises a wiping towel with an double layer edge and a corner formed on it by folding over a portion of the material and attaching it to itself. The double thickness with a stiffened edge from joining the material is a maneuvering property. The stiffened edge identifies to the user which portion of the towel is their hand. The structural properties of the wiping towel creates and ergonomic structure that results in a more manageable wiping towel. The corner formed from adjoining the material is a crevice cleaning property in itself such that the user can maneuverer the single point with their hand inserted into the corner. The user may also grab the doubled edge, and the corner exteriorly and reaching into smaller areas maneuvering the pointed corner, and stiffened edge. The user can insert their hand into the corner and wrap the additional material over their hand or wad it up into the palm of their hand, the release all of the material and use as a flattened wiping towel.

SPECIFICATION

The L Shape Half Mitt is a mitt style wiping device. The mitt open sides forming a "L" shape, open on two side, and closed on two sides. A single corner is formed, and a stiffened doubled edge is available to the user.

The L Shape Half Mitt is a mitt style wiping device, as well as a wiping towel that spreads out to be used flattened and provides the properties of a stiffened edge and a corner, and also provides a covering for a user's hand or a tool inserted within the cavity of the mitt.

The L Shape Half Mitt is a double layer of wiping material when not spread out, or a single layer when spread out and used exteriorly.

When the user inserts their hand into the mitt, the user can wrap the material around the hand, or just cover the hand and use the corner to push the mitt around on a surface. The hand is securing the mitt by its management of the material. The mitt is managed exteriorly, and interiorly at the same time.

The mitt allows for a user to slide the hand into the mitt from either of the two open sides.

The mitt compacts the material of a full towel material into a smaller area while providing a mitt and an open towel for a user at the same time. The user is able to insert the hand into the mitt, and wad or scrunch or wrap the remaining material of the full wiping towel into their hand. The pointed corner formed on the mitt provides leverage for the user's fingers to be protected inside the mitt.

The fastened edge of the mitt gives the user a stiffened portion to grasp and hook onto their hand so the user can drape the mitt over the user's hand or finger.

The user can use the towel laid flat and spread out, or doubled.

The user may cover a tool, such as a mop head, or a feather duster or a sponge placed inside the cavity.

The two open sides of the mitt allows for a large variety of combinations of forms of the mitt.

When the user turns the mitt inside out, the seam applied and fastening the material lets the user know which side has previously been used by noticing if the seam is on the inside or the outside at the time of use whether using the mitt like a mitt with a hand inside or as a towel laid out flat, or as a doubled over material.

The user can discern areas of the mitt because there is the identification of the pointed corner, open sides, and seamed edge whether using the mitt laid out flat like a towel or with the user's hand inserted into the cavity.

The size of the mitt fits a variety of user's hand sizes, or additionally can be sized for specific applications. A smaller mitt may be 5 inches by 5 inches when the mitt is in its double form.

The user can use the mitt to wash, wipe, clean, polish, exfoliate, and dry with a towel and a mitt style all in one.

The mitt is secured to user or onto a tool device when the user inserts either into the cavity of the mitt, and can further wrap the loose material around and onto the user's hand or tool device.

The user can insert a portion of their hand or fingers into the inner edge and drag and grasp the mitt with ease because of the inner edge area applied.

The double material formed of the mitt provides ease of use for the user when used exteriorly, and when the material is laid out flat in a single layer is easy to maneuver as a more compact fluid wiping material.

A ruler shape stick is easily inserted into the single closed corner of the mitt. A sponge or a feathery duster tool device with a handle is easily inserted into the cavity of the mitt and covered, and there for provides more wiping surfaces to the smaller item placed within the mitt. The extended surfaces available can exchange by repositioning the mitt material over the item it is covering and by providing new clean surfaces which are available because the mitt has surfaces that rotate, spin and turn inside out to extend the surfaces of wiping material to the user.

The material supply of a full towel is laid over and has a side fastened to form an edge.

A user may maneuver the towel laid flat as a single or a double layer in a square or a triangle shape. Inserting a user's hand into cavity of the mitt covers a user's hand and provides leverage with the hand pushing against the material sides of the cavity, and using the two closed sides for opposing leverage and the extra material can be wrapped further around the user's hand. The angle the user's hand goes into the cavity of the mitt, allows for the user's middle finger to fit into the corner and the other finger to leverage on the adjacent edges, with the two open sides freely hanging.

A ruler or duster style tool may be inserted with the cavity and up into the single corner and have the remaining material wrapped around the item placed within.

The formation of the mitt is constructed from one or more panels of a material.

Adding a scrubby or exfoliating patch to any area is also desirable.

Using two different materials to form the mitt or with two different colors is very useful in awareness of different sides and surfaces of the mitt.

If a knitted style mitt is desirable, the knitting process would form into a mitt of an item with two open sides, and two closed sides, and a seam occurring in the knitting process at the edge, as if it had been formed from a single or plural pieces of a material.

The mitt is made out of any material suitable to washing, wiping, polishing, scrubbing, and the like. One or more materials may be adjoined or fastened to another. A paper product may have a pressing, or a gluing application to seam an opening to for the mitt.

The material used to form the mitt can be any shape as in square, rectangular, triangular, circular, or any odd shaped material. The securement means to form the edge can vary as sewing, gluing, pressing, as well as knitting a mitt and forming the edge during the knitting process.

A small gap or space be left at the adjoin materials at the single corner point. The small gap area allows for air and water pass thru the corner.

An additional embodiment secures a 1-2 inch are on an open side of the two open sides of the mitt, creating a small area to leverage a use's thumb into a second short corner.

DETAILED DESCRIPTION

FIGS. 1A-10A

A preferred embodiment is a sheet of a material FIG. 1A, laid over itself FIG. 2A, and having a single edge fastened at an edge as seen in FIG. 3A FIGS. 4A to 9A shows forming the mitt using differing materials FIG. 10A Shows a small gap formed into the edge at the single corner point FIGS. 1B-2B Shows finished mitts FIGS. 1C-4C Shows variations in finished mitts FIGS. 1D-2D Shows a user using the mitt FIGS. 1E-3E Shows a user's hand inserted, and wrapping the loose material around the user's hand FIGS. 1F-3F Shows using the mitt to perform tasks FIGS. 1G-3G Shows covering items with the mitt FIGS. 1H-4H Shows how the user uses the point of the mitt FIGS. 1-I thru 4-I Shows the user manipulating the mitt FIGS. 1J-6J Shows how the user inserts and wraps the mitt around items

DRAWING FIGURES

Figure 1A:
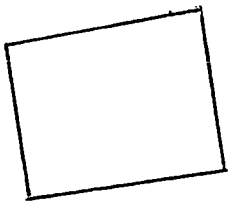
FIG. 1A shows a sheet of a material
Figure 2A:
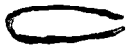
FIG. 2A shows the material of A1 laid over
Figure 3A:
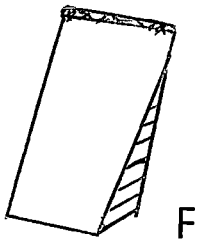
FIG. 3A show the upper edge fastened and two open sides
Figure 4A:
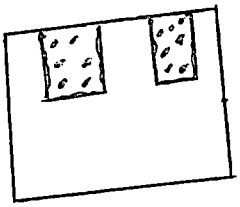
Figure 5A:
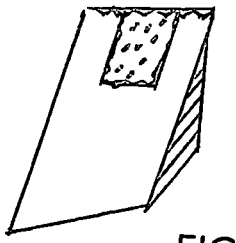
Figure 6A:
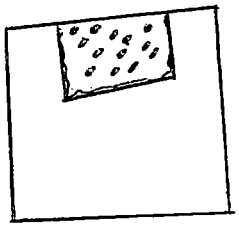
Figure 7A:
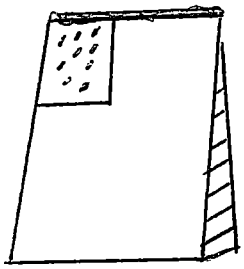
Figure 8A:
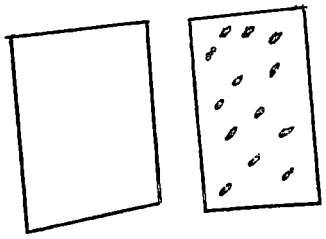
Figure 9A:
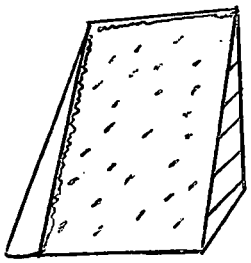
Figure 10A:
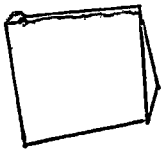
Figure 1B:
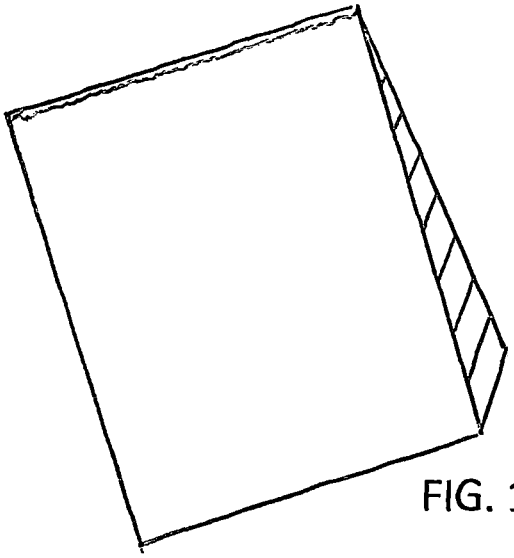
Figure 2B:
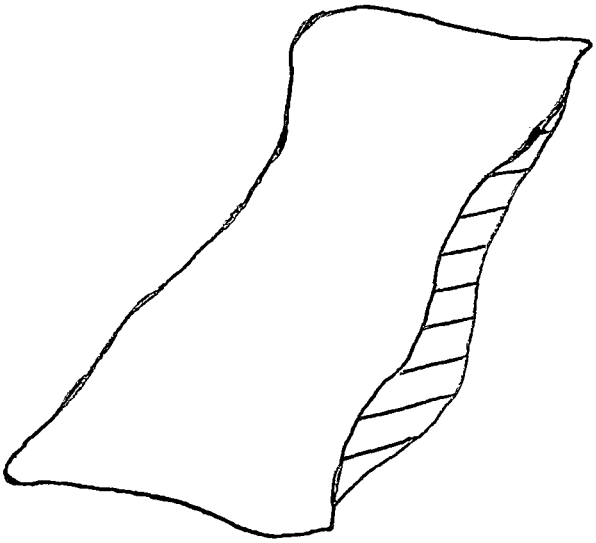
Figure 3C:
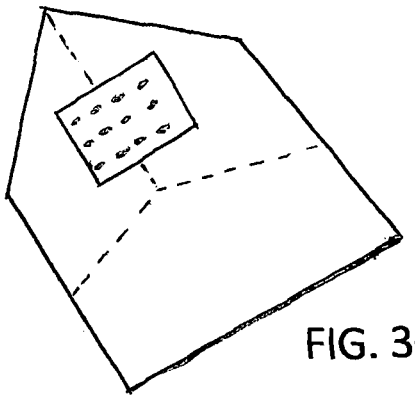
Figure 4C:
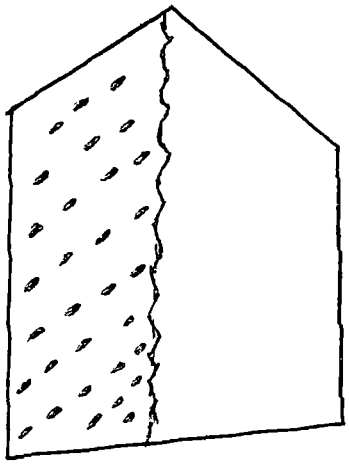
Figure 2C:
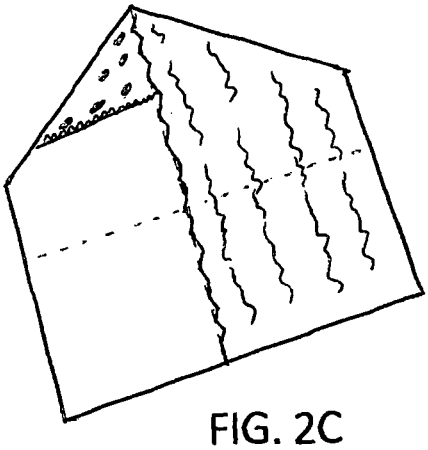
Figure 1C:
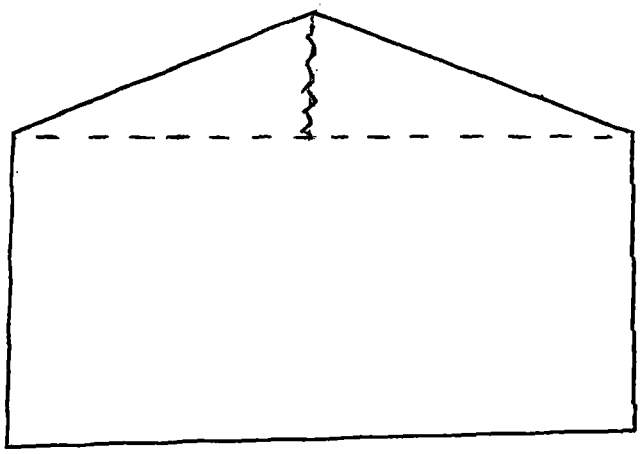
Figure 1D:
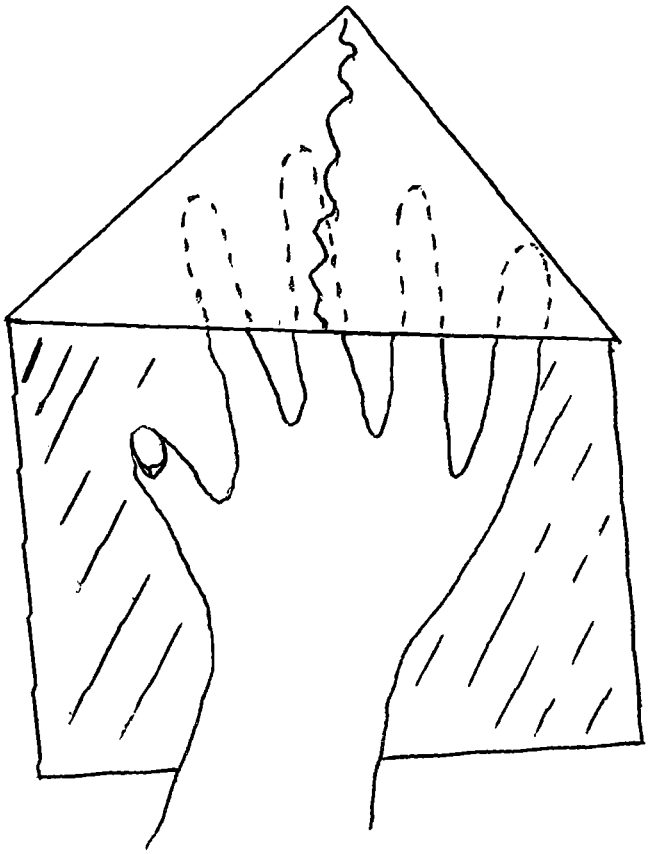
Figure 2D:
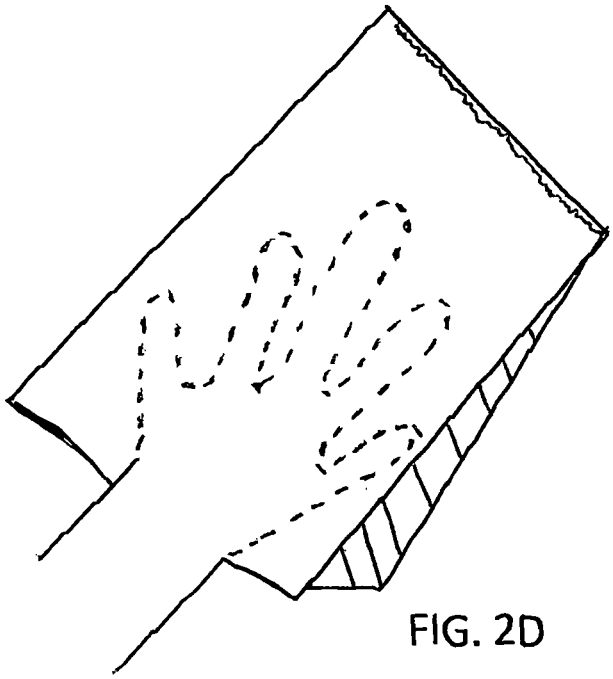
Figure 1E:
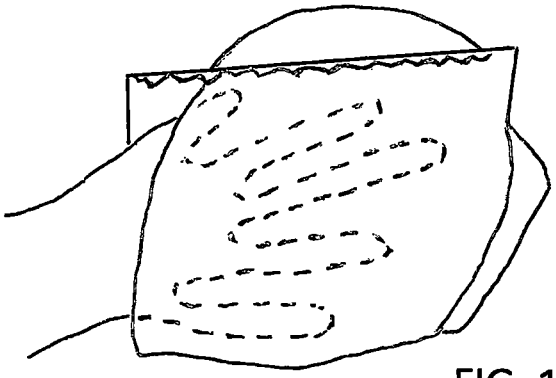
Figure 2E:
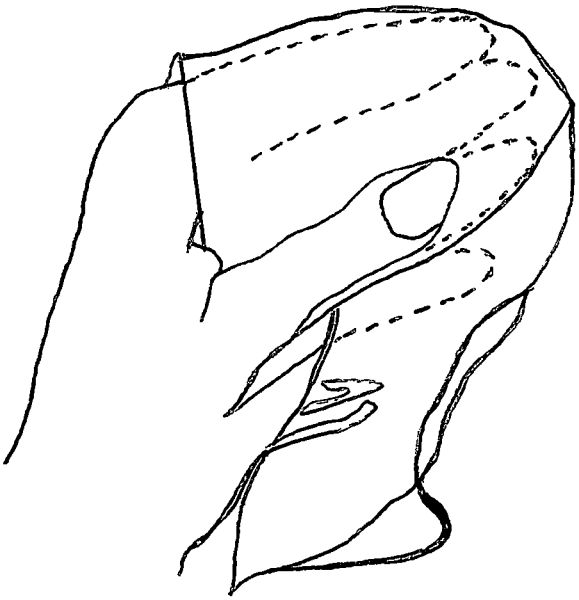
Figure 3E:
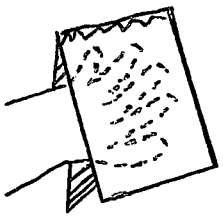
Figure 1F:
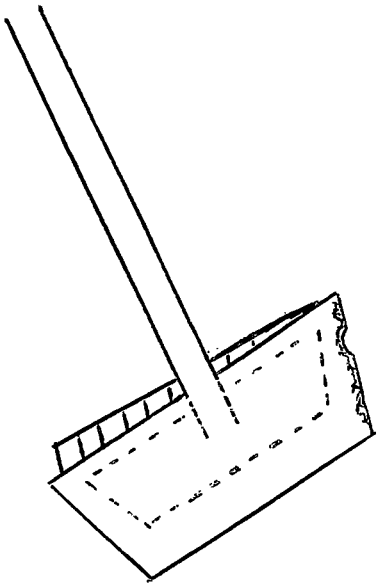
Figure 2F:
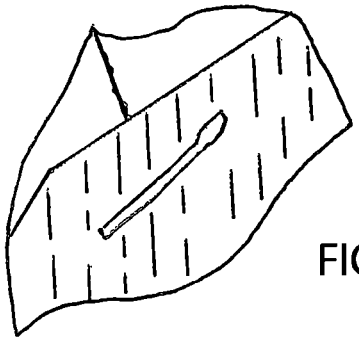
Figure 3F:
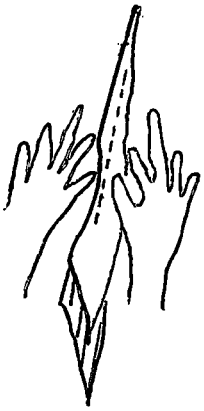
Figure 1G:
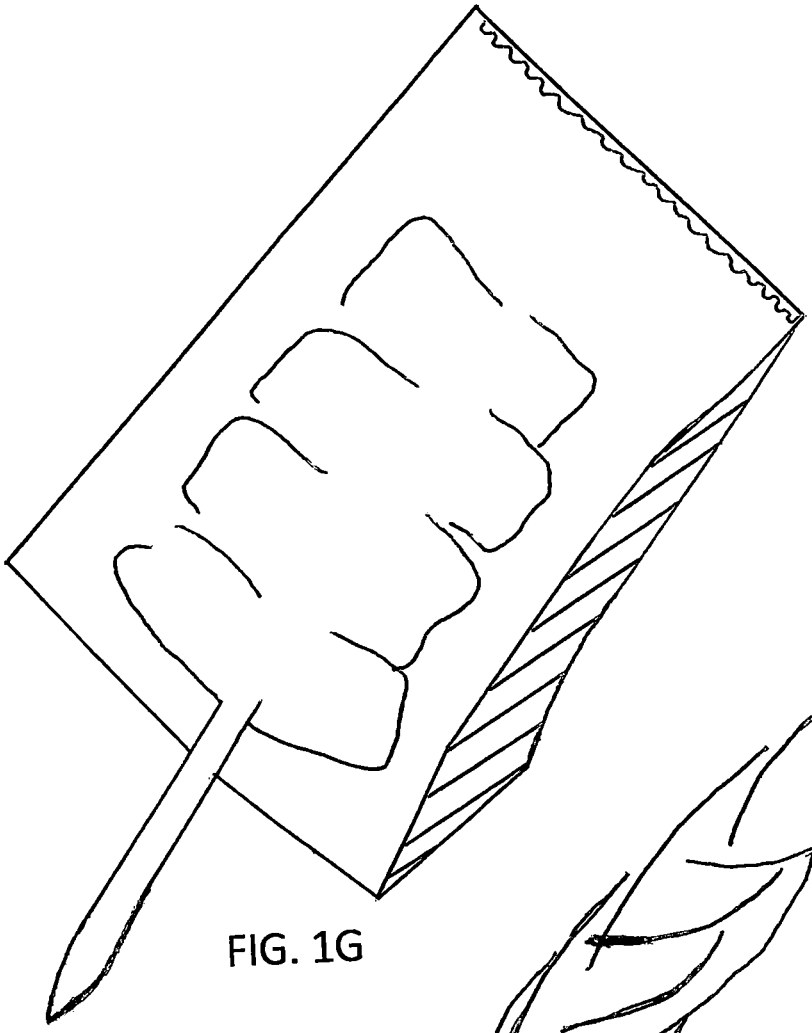
Figure 2G:
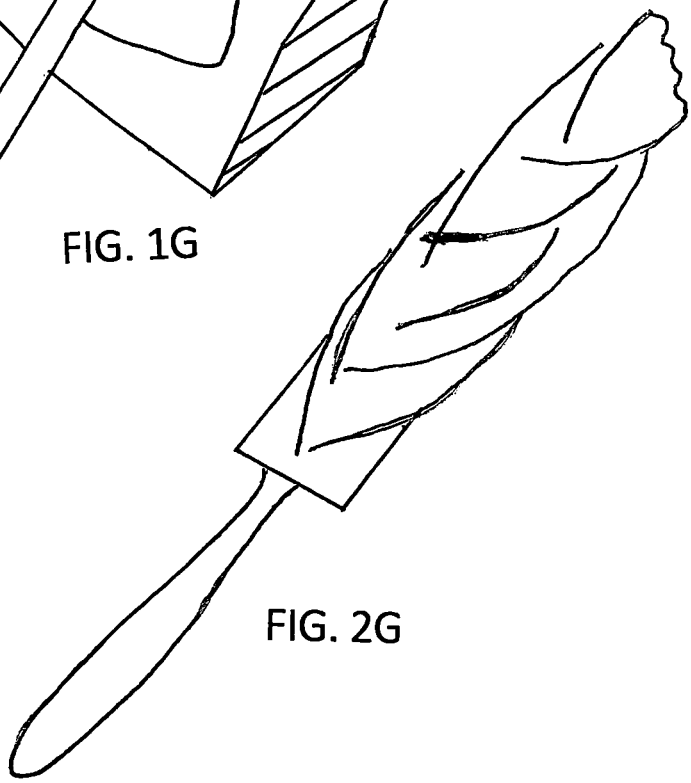
Figure 3G:
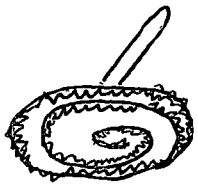
Figure 1H:
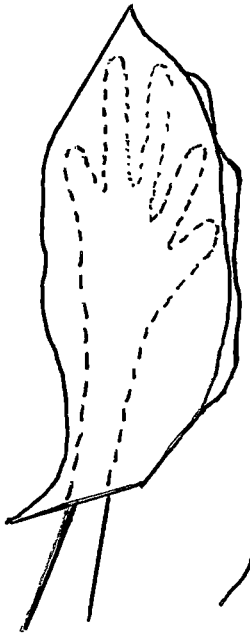
Figure 2H:
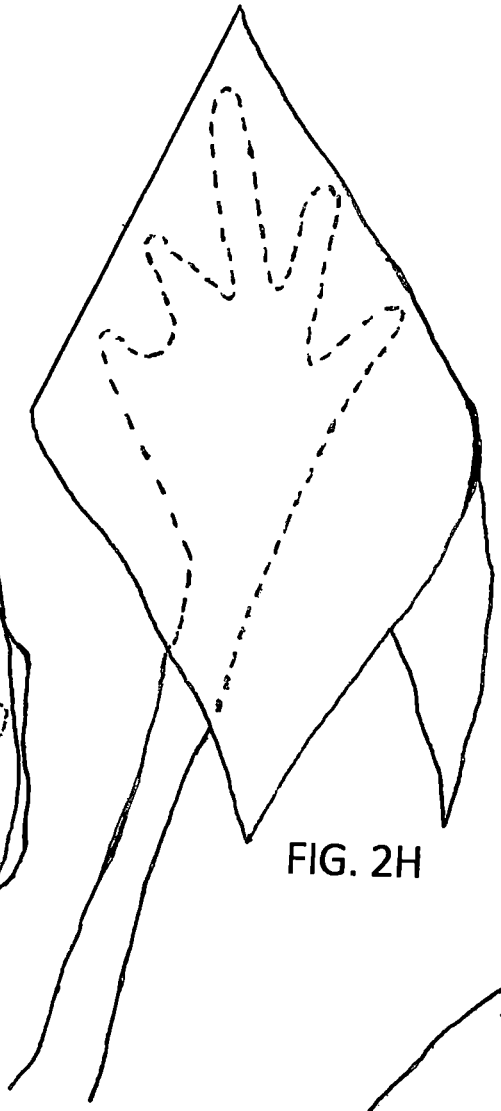
Figure 4H:
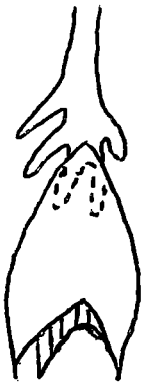
Figure 3H:
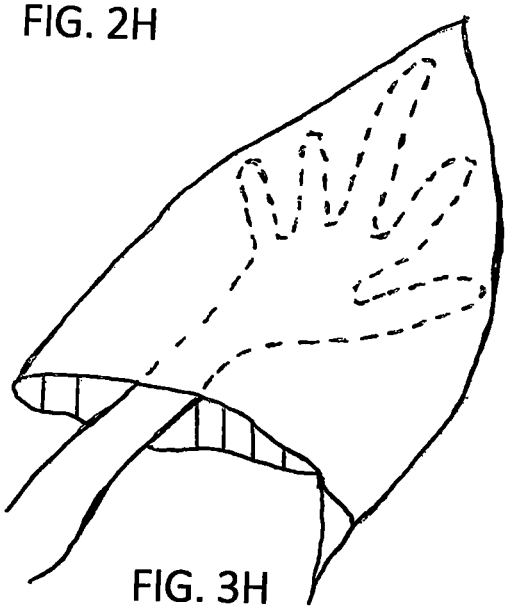
Figure 1J:
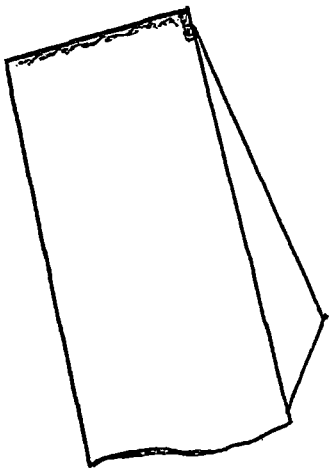
Figure 3J:
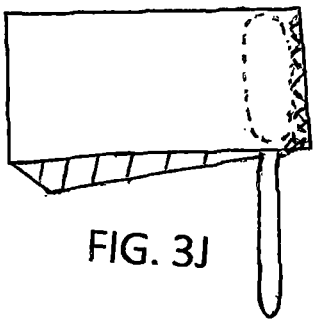
Figure 2J:
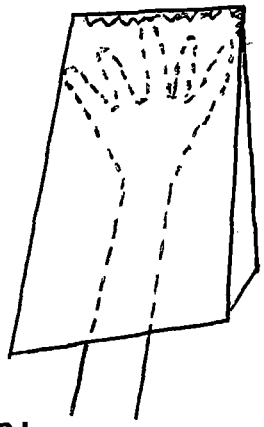
Figure 5J:
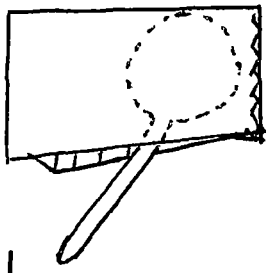
Figure 4J:
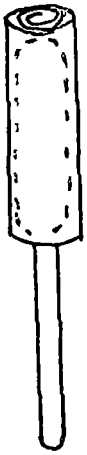
Figure 6J:
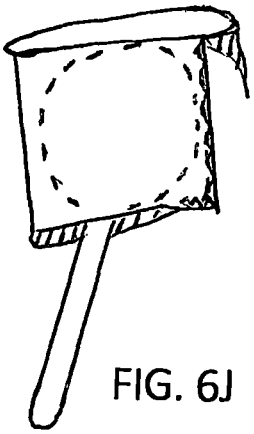

FIG. 4A shows two patches of another material applied to a sheet of a material FIG. 5A shows the upper edge of FIG. 4A fastened FIG. 6A shows a material with a patch applied FIG. 7A shows the material folded and the upper edge fastened FIG. 8A shows two panels of material FIG. 9A shows the two panels of material have been adjoined on two sides and leaving two open sides FIG. 1B shows a finished mitt with an edge fastened FIG. 2B shows a knitted mitt with no seams having two open sides and two closed sides FIG. 1C shows an exterior open mitt FIG. 2C shows two panels adjoin and a patch of differing material FIG. 3C shows a single panel with one patch of a differing material FIG. 4C shows two differing panels of material adjoined FIG. 1D shows a user's hand inserted into the mitt cavity FIG. 2D shows a user exteriorly manipulating the mitt FIG. 1E shows a user's hand inserted into the mitt cavity and the extra material wrapped around the users hand FIG. 2E shows a user's hand grasp, wad, pinch, roll and fold the material from within the cavity covering the user's hand and tightening the material wrapped around the user's hand and securing the mitt to user's hand FIG. 3E shows a user's hand inserting the cavity thru one of the two openings FIG. 1F shows a mop head inserted into the cavity thru one of the two open sides FIG. 2F shows an item placed with the interior cavity area FIG. 3F shows a user's hands manipulating the mitt over the covered item placed within FIG. 1G shows a feathery type duster inserted into the cavity of the mitt thru one of the two opening FIG. 2G shows the material of the mitt wrapped twisted and rolled around the item it is covering FIG. 3G is looking down at the item from the above item of FIG. 2G and the material of the mitt is rolled around the item placed within FIG. 1H shows a user's hand inserted with the cavity of the mitt FIG. 2H shows a user's hand creating leverage within the cavity of the by using the two sides available FIG. 3H shows the mitt fully covering a user's hand and wrist area FIG. 4H shows the pointed corner of the mitt in user's palm and the open ends hanging from the user's hand FIG. 1-I shows a mitt laid out and a user's hand exteriorly manipulating the mitt as a single layer FIG. 2-I shows a user's hand shows a single layer corner wiping a dish FIG. 3-I shows a dish laid into the open cavity while a user's hand manipulates the towels from below FIG. 4-I shows a mitt laid out flat forming a triangular shape FIG. 1J shows a small 1-2 inch additional securement on a third side of the mitt forming two corners FIG. 2J shows a user's fingers stretch out and leveraged to use both corners FIG. 3J shows a spongy cleaning tool inserted into the cavity thru one of the two openings FIG. 4J shows the loose material wrapped snuggly around the tool of J3 placed within the cavity of the mitt and shows a round headed tool placed with the cavity of the mitt with two corners FIG. 5J shows a round headed tool placed within the cavity of the mitt with two corners FIG. 6J shows the loose material of J5 folded and wrapped around the tool head placed within

I claim:

1. A cleaning towel mitt, comprising:

a single flat towel made up of a material arranged such that a pocket is formed by a single same edge adjoined to itself, the pocket further forms a paunch with an apex formed by a pattern applied to the material proximate the paunch thereby forming a permanent single gap.

2. The cleaning towel mitt of claim 1 further comprising patches of differing materials formed into the single flat towel.

* * * * *